US012630938B2

(12) United States Patent
Ötzlinger et al.

(10) Patent No.: US 12,630,938 B2
(45) Date of Patent: May 19, 2026

(54) SHIELD BODY SYSTEM FOR A PROCESS FLUID FOR CHEMICAL AND/OR ELECTROLYTIC SURFACE TREATMENT OF A SUBSTRATE

(71) Applicant: Lam Research Salzburg GmbH, Salzburg-Gnigl (AT)

(72) Inventors: Herbert Ötzlinger, Hallwang (AT); Marianne Kolitsch-Mataln, Villach (AT); Harald Okorn-Schmidt, Klagenfurt (AT); Andreas Gleissner, Döbriach (AT)

(73) Assignee: LAM RESEARCH SALZBURG GMBH, Salzburg-Gnigl (AT)

( * ) Notice: Subject to any disclaimer, the term of this patent is extended or adjusted under 35 U.S.C. 154(b) by 147 days.

(21) Appl. No.: 18/010,075

(22) PCT Filed: Mar. 25, 2021

(86) PCT No.: PCT/EP2021/057823
§ 371 (c)(1),
(2) Date: Dec. 13, 2022

(87) PCT Pub. No.: WO2021/259528
PCT Pub. Date: Dec. 30, 2021

(65) Prior Publication Data

US 2023/0313407 A1 Oct. 5, 2023

(30) Foreign Application Priority Data

Jun. 25, 2020 (EP) ..... 20182378

(51) Int. Cl.
*C25D 21/10* (2006.01)
*C25D 5/02* (2006.01)
*C25D 17/00* (2006.01)

(52) U.S. Cl.
CPC ..... *C25D 17/008* (2013.01); *C25D 5/026* (2013.01); *C25D 21/10* (2013.01)

(58) Field of Classification Search
None
See application file for complete search history.

(56) References Cited

U.S. PATENT DOCUMENTS 5,589,051 A * 12/1996 Henington ..... C25D 17/06 204/279
6,106,687 A * 8/2000 Edelstein ..... C25D 17/001 204/279

(Continued)

FOREIGN PATENT DOCUMENTS

CN 105765111 A 7/2016
CN 106637331 A 5/2017

(Continued)

OTHER PUBLICATIONS

English translation CN 106637331 (Year: 2017).*

(Continued)

*Primary Examiner* — Stefanie S Wittenberg
(74) *Attorney, Agent, or Firm* — Meunier Carlin & Curfman LLC

(57) ABSTRACT

The invention relates to a shield body system for a process fluid for chemical and/or electrolytic surface treatment of a substrate, use of a shield body system, and a method for a chemical and/or electrolytic surface treatment of a substrate in a process fluid. The shield body system comprises a shield body and an agitation unit. The shield body has a plurality of openings to direct the process fluid flow and/or a current density distribution towards the substrate to be treated. The agitation unit is configured to move the shield body together with the substrate vertically and/or horizontally relative to a distribution body. Alternatively or additionally, the agitation unit is configured to move the shield body together with the (Continued)

substrate vertically and/or horizontally relative to a deposition chamber for chemical and/or electrolytic surface treatment.

7 Claims, 1 Drawing Sheet

(56) References Cited

U.S. PATENT DOCUMENTS

| | | | | |
|---|---|---|---|---|
| 2011/0308955 | A1* | 12/2011 | Olson | H01L 21/68764 204/297.05 |
| 2013/0186852 | A1* | 7/2013 | Dietrich | H01L 21/02 427/256 |
| 2014/0216940 | A1* | 8/2014 | Wang | C25D 5/08 205/137 |
| 2016/0258080 | A1* | 9/2016 | Kimura | C25D 17/06 |
| 2019/0271095 | A1* | 9/2019 | Kimura | C25D 21/10 |
| 2020/0373267 | A1* | 11/2020 | Shih | C25D 17/001 |

FOREIGN PATENT DOCUMENTS

| | | | |
|---|---|---|---|
| CN | 109306474 | A | 2/2019 |
| CN | 109309034 | A | 2/2019 |
| GB | 2570268 | A | 7/2019 |
| KR | 20100037896 | A | 4/2010 |
| KR | 20130138448 | A | 12/2013 |
| TW | 201435147 | A | 9/2014 |

OTHER PUBLICATIONS

English translation TW 538981 (Year: 2003).*

International Search Report and Written Opinion in International Application No. PCT/EP2021/057823, mailed Jun. 14, 2021, 16 pages.

Extended European Search Report in European Application No. 20182378.8, dated Jan. 12, 2021, 9 pages.

Office Action received in connection with CN Application No. 202180037038.4, dated Dec. 9, 2024, 9 pages.

Office Action mailed on Jan. 17, 2025, in Taiwanese Application No. 110117121.

* cited by examiner

SHIELD BODY SYSTEM FOR A PROCESS FLUID FOR CHEMICAL AND/OR ELECTROLYTIC SURFACE TREATMENT OF A SUBSTRATE

TECHNICAL FIELD

The invention relates to a shield body system for a process fluid for chemical and/or electrolytic surface treatment of a substrate, use of a shield body system, and a method for a chemical and/or electrolytic surface treatment of a substrate in a process fluid.

BACKGROUND

Chemical and/or electrolytic surface treatment like electroless and electrochemical or electrolytic treatment or deposition is frequently used for surface coating of planar, as well as non-planar, patterned or not patterned, non-metallic as well as metallic and/or metallized surfaces.

Nowadays, processes, which produce a current density distribution, which is uniformly distributed over the entire surface of a large substrate to be plated is in many cases not anymore efficient and adequate. This is mainly due to the continuous shrinking of the surface elements to be plated (i.e. electronic device geometries are continuing to scale down to ever smaller dimensions) and their accumulation in high density device areas, while other areas on the substrate are having a very low density of features required to be plated and in some cases also very large features. In addition, when trying to achieve highly uniform metal plating to fabricate very thick 3D metal structures (also called mold-plating or mold-electroplating) on especially very large scale substrates, many challenges have to be overcome from the perspectives of the plating process, the equipment design and the substrate handling. For example, recesses become exposed on the substrate in which the plating is targeted to happen through prior deposition and adequate structuring of a thick photoresist layer on the substrate to be plated.

One of the main challenges during a plating process is the establishment, but also the maintenance of a well-controlled current distribution between the anode (usually made of an inert material or out of the metal that needs to be deposited, e.g. copper) and the cathode (generally the substrate) during the entire plating process. Anode and cathode can also be temporarily reversed for special plating applications.

In the prior art, the current distribution can be established and controlled through a patterned, thick photoresist layer, guiding the current for the electrodeposition to an open recess, where plating then can happen. However, in this basic process, the current distribution is mainly only guided to the open areas within the last few μm before the substrate. The main influence of the current distribution however happens already at a larger distance before this final distribution adjustment in the μm-scale. Therefore, it is not possible to achieve efficiency and high uniformity in a satisfactory manner.

An example apparatus and a method for generating targeted flow and current density patterns in a chemical and/or electrolytic surface treatment is disclosed in DE102010033256A1. The device comprises a flow distributor body, which is arranged plane-parallel with its front side oriented to a substrate to be processed, and which has outlet openings on the front side, through which process solution flows onto the substrate surface. However, in this case, even so the plating process can be improved and the current distribution can be made more uniform in the macroscopic scale and with respect to the overall panel size, the targeted current distribution to the specific recesses in the μm-range cannot be sufficiently achieved.

Especially when performing a mold-plating process to achieve very thick metal layers in predefined areas and lines, additional options to adjust and focus especially the current distribution are needed.

SUMMARY

Hence, there may be a need to provide an improved shield body system for a process fluid for chemical and/or electrolytic surface treatment of a substrate, which allows a well-controlled current distribution and a uniform electroplating of substrates.

Above described problem is solved by the subject-matters of the independent claims, wherein further embodiments are incorporated in the dependent claims. It should be noted that the aspects of the disclosure described in the following apply also to a shield body system for a process fluid for chemical and/or electrolytic surface treatment of a substrate, a use of a shield body system, and a method for a chemical and/or electrolytic surface treatment of a substrate in a process fluid.

According to the present disclosure, a shield body system for a process fluid for chemical and/or electrolytic surface treatment of a substrate is presented. The shield body system comprises a shield body and an agitation unit. The shield body has a plurality of openings to direct or allow a passage of the process fluid flow and/or a current density distribution towards the substrate to be treated. The agitation unit is configured to move the shield body together with the substrate vertically and/or horizontally relative to a distribution body. The distribution body may comprise a plurality of openings to direct the process fluid flow and/or the current density distribution towards the shield body. The distribution body may cause an acceleration or deceleration of the process fluid flow and/or current density towards the substrate. Alternatively or additionally, the agitation unit is configured to move the shield body together with the substrate vertically and/or horizontally relative to a deposition chamber for chemical and/or electrolytic surface treatment.

The shield body system according to the present disclosure is solving the issues of the prior art by implementing a novel way of surface treatment by directing the process fluid flow and/or current density distribution through the openings of the shield body onto the substrate to be treated. The agitation unit of the present disclosure is configured to move the shield body with the substrate in a vertical and/or a horizontal direction for a controlled and uniform chemical and/or electrolytic surface treatment of the substrate.

The main advantage of this novel equipment design is that, for example, not (only) a photoresist layer is responsible for guiding the electrolyte and/or the current flow distribution to the surface elements to be plated (on a microscopic scale in μm-range). The shield body is responsible for guiding the electrolyte and/or the current flow distribution already on a macroscopic scale, for the microscopic scale to become more influential. The shield body can also be seen as an additional plating mask and may allow focusing the electrolyte and/or the current density to important surface areas, already in a close distance (for instance up to a few mm upstream) of the substrate and may thereby enable higher plating efficiencies and uniformities in the final plating results in a nanometres range scale.

The shield body can be understood as a plate with holes. An opening of the shield body may have a circular shape, an angular shape or a line shape. A line shaped opening may have a straight, round, zigzag or corrugated shape or the like. The plurality of openings may comprise combinations of differently shaped or sized openings or all can be the same. A circular or angular opening may have a diameter or width of 0.1 μm to 12 μm, preferably 0.5 μm to 6 μm. A line shaped opening may have a length of 0.5 μm to 6 μm. Adjacent openings may have a distance between each other of 5 μm to 80 μm (preferably for circular or angular openings) and/or 0.1 μm to 12 μm (preferably for line shaped openings). The agitation unit can be understood as an electric or hydraulic engine or the like.

In an embodiment, the shield body is positioned and/or dimensioned so that the openings of the shield body correspond exactly or approximately to the surface elements of a substrate, which are to be treated. This can be understood in that the number, position, size, shape and/or the like of the openings of the shield body is/are designed to correspond to the number, position, size, shape and/or the like of the surface elements of a substrate. Any number, position, size, shape (e.g. circular, angular etc.), and/or the like of the openings of the shield body is/are possible.

For example, a substrate with a higher number of surface elements can be treated by a shield body with a higher number of openings on the surface facing the substrate. In an example, the shield body is positioned and/or dimensioned so that the openings of the shield body correspond to the surface elements of a substrate, which are to be treated, but are adjusted in dimensions to a density of the surface elements. By dimensioning and arranging the openings corresponding to the surface elements, an accurate treatment on the targeted surface elements and a uniform electroplating of a substrate can be achieved. The openings of the shield body can be positioned and/or dimensioned with respect to the surface elements of the substrate to be treated automatically, as well as manually, before the start of the surface treatment.

The wording "correspond approximately" can be understood in that a number, position, size, shape and/or the like of the openings of the shield body is/are designed to approximately correspond to a number, position, size, shape and/or the like of the surface elements of the substrate. The number, position, size, shape and/or the like of the openings of the shield body can also be slightly adjusted in the number, position, size and shape and/or the like in order to improve the μm-scale plating result. For example, for very high-density structures, it can be of advantage for the final plating uniformity to slightly increase or widen the number, position, size, shape, and/or the like of the openings of the shield body. In certain cases, it can also be of advantage to decrease the number, position, size, shape, and/or the like of the openings of the shield body.

Further, the shield body may have approximately the size of the substrate to be plated. More specifically, the shield body may have the size of the surface of the substrate to be plated to achieve an even more uniform electroplating of the substrate. The shield body can be also wider than the substrate to be treated in order to guarantee that the process fluid does not arrive at the substrate surface from an unwanted area.

In an embodiment, the shield body system further comprises a rotation unit configured to rotate the shield body together with the substrate relative to a distribution body. In this embodiment, the shield body and the substrate can be rotated on parallel axes. The rotation unit may rotate the shield body together with the substrate on an axis parallel, perpendicular or angled to the distribution body. In other words, the shield body or the substrate may face the distribution body and rotate on the axis, which is parallel to the axis that is passing through the distribution body. Alternatively, the rotation unit can rotate the shield body and the substrate on an axis angled to the axis passing through the distribution body. The angle may be in a range of 0° to 90°, preferably 45°. When the angle is 0°, the rotation axis is parallel to the distribution body/substrate axis. When the angle is 90°, the rotation axis is perpendicular to the distribution body/substrate axis. Of course, the angle can be selected to be any value between 0° and 90°. Similarly, the angle can be selected to be between 90° and 180° for treating a reverse side of the substrate.

In an embodiment, the shield body system further comprises a rotation unit configured to rotate the shield body together with the substrate relative to a deposition chamber for chemical and/or electrolytic surface treatment. This can be understood in that the rotation unit rotates the shield body with the same speed, acceleration and/or the like as the substrate. The rotation unit may be an electric, hydraulic or the like engine. The rotation unit may allow a homogenous surface treatment (an even and thorough deposition on the surface elements) by rotating the substrate relative to the distribution body and/or the deposition chamber. Simultaneous rotation of the shield body and the substrate may allow the openings and the surface elements to stay engaged and aligned throughout the process. The distribution body and/or the deposition chamber may be part of the shield body system.

In an embodiment, the shield body system further comprises a distribution body with a plurality of openings to direct the process fluid flow and/or a current density distribution towards the shield body. The shield body may be arranged next to the distribution body with a distance of 50 μm to 12 mm. The distribution body can be understood as a plate comprising an array of openings for a process fluid distribution. Still, the distribution body can have any other shape that would allow a transfer of the process fluid flow and/or a current density distribution towards the shield body. The distribution body may be arranged between an anode and the shield body body, at a side of the shield body facing the anode and at a distance of 50 μm to 12 mm to the shield body. The distance between the shield body and the distribution body may also be 100 μm to 5 mm, and preferably 500 μm to 1 mm. Accordingly, the process fluid may be firstly directed by the distribution body onto the shield body, and therefrom passes through the openings of the shield body, arriving onto the substrate. By such two-level directing of process fluid onto the substrate and/or the close proximity between distribution body and shield body, a more accurate surface treatment on the targeted surface elements may be achieved. The distance between the distribution body and the shield body may be selected to ensure that the process fluid flow and/or the current density distribution passes through the openings of both the distribution body and the shield body in an effective way.

The distribution body may have essentially the same size as the substrate, more specifically, the same size of the surface of the substrate facing the distribution body. Accordingly, the process fluid flow and/or a current density distribution may be completely applied to all parts of the substrate.

The distribution body may be a high-speed plate (HSP). The HSP comprises a plurality of jets to direct the process fluid to the substrate and a plurality of drains for a return flow of the process fluid back from the substrate and through the drains of the HSP. The drains are arranged next to or around the jets. In other words, there is at least a drain dedicated or assigned to a jet. Preferably, there are a plurality of drains dedicated or corresponding to a smaller amount of jets. As a result, the flow paths are rather short and/or the flow cell is rather small. This is in particular in comparison to prior art distribution bodies without drains. They guide the backflow via the open edges of the distribution body and therefore form much longer flow paths and/or larger flow cells. As a result, the HSP can allow that the process fluid is accelerated and/or that it is easier to control, balance and/or equilibrate the current distribution towards the substrate.

For the same reason, the shield body may comprise at least a return aperture configured to direct a return flow of the process fluid in an opposite direction to the direction towards the substrate. The return flow improves and accelerates the flow of the process fluid. In an embodiment, the at least one return aperture has an aperture surface, which is smaller than a combined openings surface of the plurality of openings. The combined openings surface of the plurality of openings can be understood as a sum of all opening surfaces. Yet, the surface of the return aperture may be larger than the combined openings of the shield body for easing the return fluid flow and to prevent occurrence of a blockage in the return aperture.

In an embodiment, the shield body system further comprises an attachment unit configured to attach the shield body to the substrate or a substrate holder holding the substrate. The attachment unit may be understood as a mechanic fixation unit, as for example one or more screws, clips or the like. By attaching the shield body system and the substrate to each other, a distance between them may be kept constant. The attachment unit may be configured to provide a predetermined distance between the shield body and the substrate. The distance between the shield body system and the substrate may vary from a few μm to a few mm, depending on the results that need to be achieved. For instance, the distance may be in a range of 50 μm to 12 mm. Specifically, the shield body may be placed at a distance of 1 to 5 mm away from the substrate. The attachment unit can further attach the shield body to the agitation unit within a specific distance from the substrate surface to be plated. By fixing the shield body to the substrate or the agitation unit, the shield body is able to be agitated synchronously with the substrate. The synchronous agitation allows a continuous supply of electrolyte and/or current density distribution to the areas (e.g. open areas) on the substrate, which are to be plated, to achieve a uniform plating.

In an embodiment, the shield body system further comprises an alignment unit configured to align the shield body relative the substrate. The alignment unit may be understood as a processor configured to control a relative movement between the shield body and the substrate. Yet, alternatively, the alignment unit may comprise a manual handling of the shield body and/or the substrate to align them with respect to each other. In this example, a user may align the shield body and the substrate that is treated with or without the automatic alignment provided by the alignment unit (or the processor). Aligning the shield body and the substrate by the alignment unit can, therefore, also include both an automatic alignment and manual correction. By aligning the shield body and the substrate, the openings of the shield body may be kept aligned with the surface elements to be plated throughout the process. Accordingly, the chemical and/or electrolytic surface treatment may continue without significant disturbance. In an example, the alignment unit may control the agitation unit to move the shield body with respect to the substrate for aligning thereof. Accordingly, an automatic alignment of the shield body with respect to the substrate may be allowed.

In an example, the substrate may comprise additional photoresist patterns (either open or closed areas). The openings of the shield body may be a partial (quasi) or a complete copy of the photoresist patterns on the substrate. The areas of shield body corresponding to the photoresist areas of the substrate may be in a solid, non-penetrable state, especially when the substrate comprises at least one closed photoresist area. When the substrate comprises photoresist areas, which are open for enabling a plating of metal lines, e.g. copper lines, the shield body comprises openings in order for the electrolyte and/or the plating current to reach specific areas of the substrate surface to be plated.

Additionally or alternatively, the shield body system may further comprise a die arranged between the shield body and the substrate. The die may be positioned in a close distance (for instance up a 100 μm to 1 mm) upstream of the substrate. The die may have openings with a circular shape, an angular shape or a line shape. A line shaped opening may have a straight, round, zigzag or corrugated shape or the like. The openings of a die may comprise combinations of differently shaped or sized openings or all can be the same. A size of the die openings may be equal to, smaller or larger than a size of the openings of the shield body. A circular or angular die opening may have a diameter or width of 0.1 μm to 12 μm, preferably 0.5 μm to 6 μm. A line shaped die opening may have a length of 0.5 μm to 6 μm. Adjacent die openings may have a distance between each other of 5 μm to 80 μm (preferably for circular or angular die) and/or 0.1 μm to 12 μm (preferably for line shaped die). The die and the die openings may allow a further focusing of the electrolyte and/or the current density to specific surface areas and may thereby enable higher plating efficiencies and uniformities in the final plating results in a μm range scale.

In an example, the shield body is configured to be easily replaced depending on a structure of the substrate to be plated. For example, for plating a substrate with less dense surface elements, a shield body with a lower number of openings or smaller openings can be selected. The openings of the shield body can be varied with respect to number, position, size, shape and/or the like to adjust for a varying density of the surface elements.

In an example, the shield body may have a form of a preferably flat plate. Yet, a shape of the surface of the shield body may correspond to a shape of the surface of the substrate. For example, when the substrate has a planar or curved surface, also the shield body may have a planar or curved surface. In an example, the shield body may comprise a shield body part, which is preferably held by a shield body frame.

In an example, the shield body may be made of glass, quartz, or any other metal or plastic material, which is not interfering the chemical and/or electrolytic surface treatment process. The material can be selected in order to avoid collection of an electric charge on the shield body.

The shield body system may be used in pre-wetting systems. The pre-wetting system may comprise a rotation unit. In an example, the shield body system may be used in a mold-plating application. Yet, the shield body system may be used in other than mold-plating applications. Furthermore, the shield body system, preferably with the rotation unit may be particular advantageous for vertical plating systems as well as horizontal plating systems (for example in horizontal processing) with specific current density distribution requirements, where substrates (e.g. circular shaped substrates) may be rotated above an on-streaming process fluid (e.g. electrolyte flow). The rotation axes of the substrates may be, therefore, parallel or perpendicular to the axis on which the distribution body is placed. When the shield body is in a horizontal position, the rotation unit can be rotating the shield body in a plane parallel to the process fluid flow.

According to the present disclosure, also a use of a shield body system for treating surface elements on a substrate is presented.

In an embodiment, the surface elements of the substrate at least partially have a thickness of 0.1 μm to 12 μm. The surface elements may specifically have a thickness of 0.5 μm to 6 μm.

In an embodiment, the surface elements of the substrate are line shaped. Adjacent surface elements may have a distance between each other of 0.1 μm to 12 μm. The line shaped surface elements may specifically have a thickness of 0.5 μm to 6 μm. In an embodiment, the surface elements of the substrate are pillar shaped. Adjacent surface elements may have a distance between each other of 5 μm to 80 μm. The pillar shaped surface elements may specifically have a thickness of 10 μm to 40 μm In an embodiment, the shield body has a size essentially equal to a size of the substrate to be treated. The relevant size may be a size of a surface of the substrate facing the distribution body. The size of the shield body may be nevertheless smaller or larger than the substrate surface to be plated.

According to the present disclosure, also a method for a chemical and/or electrolytic surface treatment of a substrate in a process fluid is presented. The method for a chemical and/or electrolytic surface treatment comprises the following steps, not necessarily in this order:

- providing a shield body, wherein the shield body comprises a plurality of openings,
- providing an agitation unit, wherein the agitation unit is configured to move the shield body together with the substrate vertically and/or horizontally relative to a distribution body and/or relative to a deposition chamber for chemical and/or electrolytic surface treatment,
- directing the process fluid flow and/or a current density distribution out of the shield body towards the substrate, and
- chemically and/or electrolytically treating the surface elements of the substrate.

The agitation unit can move the shield body together with the substrate to make sure that the process fluid and/or current density distribution is directed to the substrate to reach the surface elements through the openings of the shield body. By targeting the surface elements in such a precise manner, the process fluid flow and/or the current density distribution can be efficiently used and the substrate can be uniformly plated.

In an embodiment, the method may further comprise a step of moving the shield body together with the substrate vertically and/or horizontally relative to a distribution body and/or relative to a deposition chamber for chemical and/or electrolytic surface treatment. Parallel, analogue, or corresponding movement of the shield body and the substrate together in either a vertical or a horizontal direction may be selected depending on the structure of the surface elements on the substrate and/or how the surface elements are positioned.

In an example, the method may further comprise a step of feeding an excess process fluid back to the shield body system. The process fluid coming from a return aperture may be fed back into the process fluid flow to be used in the chemical and/or electrolytic surface treatment. Accordingly, the process fluid may be efficiently used.

BRIEF DESCRIPTION OF THE DRAWINGS

Exemplary embodiments of the disclosure will be described in the following with reference to the accompanying drawing.

DETAILED DESCRIPTION OF EMBODIMENTS

Figure 1:
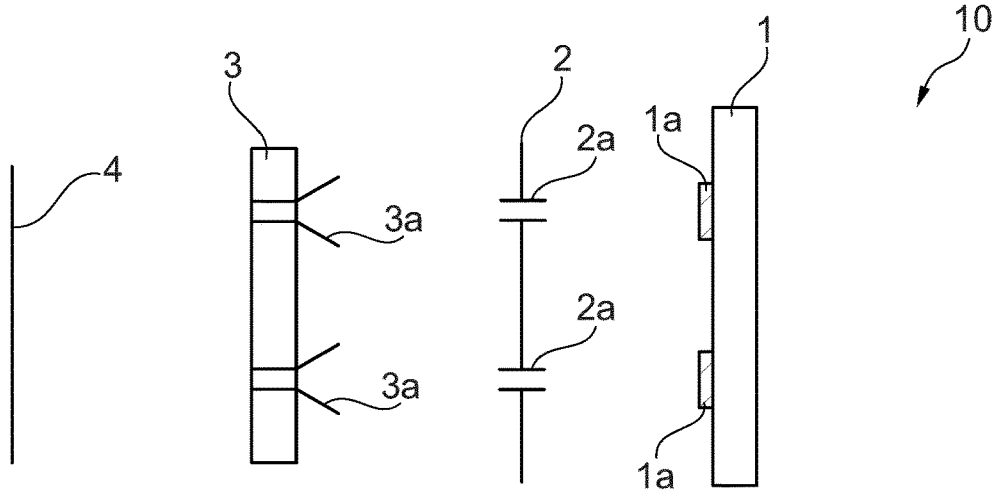
FIG. 1 shows schematically and exemplarily an embodiment of a shield body system according to the disclosure for a process fluid for chemical and/or electrolytic surface treatment of a substrate.

FIG. 1 shows schematically and exemplarily an embodiment of a shield body system 10 for a process fluid for chemical and/or electrolytic surface treatment of a substrate 1.

The shield body system 10 comprises a shield body 2 and an agitation unit (not shown). The shield body 2 has a plurality of openings 2*a* to direct a process fluid flow and/or a current density distribution towards the substrate 1 to be treated. The agitation unit is configured to move the shield body 2 together with the substrate 1 vertically and/or horizontally relative to a distribution body 3. Alternatively or additionally, the agitation unit is configured to move the shield body 2 together with the substrate 1 vertically and/or horizontally relative to a deposition chamber (not shown) for chemical and/or electrolytic surface treatment.

The shield body 2 is positioned and/or dimensioned so that the openings 2*a* of the shield body 2 correspond to surface elements 1*a* of the substrate 1, which are to be treated. The number, position, size, shape, and/or the like of the shield body 2 is designed to correspond to the number, position, size, shape, and/or the like of the surface elements 1*a* of the substrate 1. By dimensioning and arranging the openings 2*a* corresponding to the surface elements 1*a*, an accurate treatment on the targeted surface elements 1*a* and a uniform electroplating of the substrate 1 is ensured. Further, the shield body 2 has approximately the size of the substrate 1 to be plated. More specifically, the shield body 2 has the size of the surface of the substrate 1 to be plated to achieve an even more uniform electroplating of the substrate 1.

The shield body system 10 further comprises a rotation unit (not shown) configured to rotate the shield body 2 together with the substrate 1 relative to the distribution body 3 and/or relative to a deposition chamber (not shown) on a parallel axis for chemical and/or electrolytic surface treatment. The rotation unit rotates the shield body 2 with the same speed, acceleration and/or the like as the substrate 1. The rotation unit allows a homogenous surface treatment (an even and thorough deposition on the surface elements 1*a*) by rotating the substrate 1 relative to the distribution body 3 and/or the deposition chamber. Simultaneous rotation of the shield body 2 and the substrate 1 allows the openings 2*a* and the surface elements 1*a* to stay engaged and aligned throughout the process.

The shield body system 10 further comprises a distribution body 3 with a plurality of openings 3*a* to direct the process fluid flow and/or a current density distribution towards the shield body 2. The shield body 2 is arranged next to the distribution body 3 with a distance of 50 μm to 12 mm. The distribution body 3 is a plate comprising an array of openings 3*a* for a process fluid distribution. As shown in FIG. 1, the distribution body 3 is arranged between an anode 4 and the shield body 2, at a side of the shield body 2 facing the anode 4 and at a distance of 50 μm to 12 mm to the shield body 2. Accordingly, the process fluid is firstly directed by the distribution body 3 onto the shield body 2, and therefrom passes through the openings 2*a* of the shield body 2, arriving onto the substrate 1. By such two-level directing of process fluid onto the substrate 1, a more accurate surface treatment on the targeted surface elements 1*a* is achieved.

The distribution body 3 has essentially the same size as the substrate 1, more specifically, the same size of the surface of the substrate 1 facing the distribution body 3. Accordingly, the process fluid flow and/or a current density distribution is applied to all parts of the substrate 1.

FIG. 1 shows the shield body 2 in a form of a flat plate. The flat plate shape of the shield body 2 corresponds to the shape of the substrate 1.

The shield body 2 has approximately the size of the substrate 1 to be plated. More specifically, the shield body 2 has the size of the surface of the substrate 1 to be plated.

Figure 2:
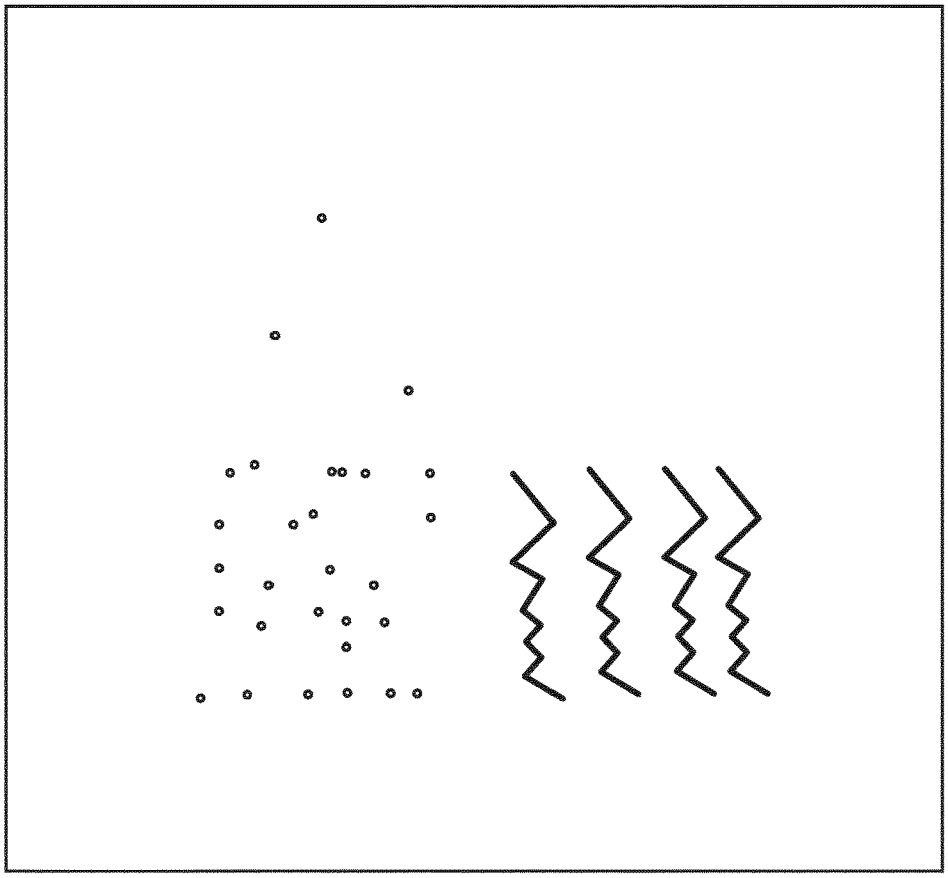
FIG. 2 shows schematically and exemplarily a top view on a die with a plurality of circular and line shaped openings.

FIG. 2 shows schematically and exemplarily a top view on a die with a plurality of circular and line shaped openings. FIG. 2 can also be considered as a top view on a shield body with a plurality of circular and line shaped openings. Further, FIG. 2 can be considered as a top view on a substrate with a plurality of circular and line shaped openings. The die, the shield body and/or the substrate are positioned and/or dimensioned so that the openings of the die, the shield body and/or the substrate correspond each other.

It has to be noted that embodiments of the disclosure are described with reference to different subject matters. In particular, some embodiments are described with reference to method type claims whereas other embodiments are described with reference to the device type claims. However, a person skilled in the art will gather from the above and the following description that, unless otherwise notified, in addition to any combination of features belonging to one type of subject matter also any combination between features relating to different subject matters is considered to be disclosed with this application. However, all features can be combined providing synergetic effects that are more than the simple summation of the features.

While the disclosure has been illustrated and described in detail in the drawings and foregoing description, such illustration and description are to be considered illustrative or exemplary and not restrictive. The disclosure is not limited to the disclosed embodiments. Other variations to the disclosed embodiments can be understood and effected by those skilled in the art in practicing a claimed disclosure, from a study of the drawings, the disclosure, and the dependent claims.

In the claims, the word "comprising" does not exclude other elements or steps, and the indefinite article "a" or "an" does not exclude a plurality. A single processor or other unit may fulfil the functions of several items re-cited in the claims. The mere fact that certain measures are re-cited in mutually different dependent claims does not indicate that a combination of these measures cannot be used to advantage. Any reference signs in the claims should not be construed as limiting the scope.

The invention claimed is:

1. A shield body system for a process fluid for chemical and/or electrolytic surface treatment of a substrate, the shield body system comprising:

a substrate holder, a shield body, and an agitation unit, wherein the substrate holder is configured to hold the substrate during surface treatment, wherein the shield body defines a plurality of openings to direct a process fluid flow and/or a current density distribution towards the substrate to be treated held by the substrate holder, wherein the agitation unit is configured to move the shield body and substrate held by the substrate holder together vertically and horizontally relative to a distribution body for chemical and/or electrolytic surface treatment, and the shield body system further comprising the distribution body defining a plurality of openings through which the process fluid flow and/or the current density distribution can be directed towards the shield body, wherein the shield body is configured to be arranged between the substrate held by the substrate holder and the distribution body, wherein the shield body is arranged next to the distribution body within a distance of 50 μm to 12 mm.

2. The shield body system according to claim 1, wherein the shield body is positioned and/or dimensioned so that the openings of the shield body correspond to surface elements of the substrate, which are to be deposited.

3. The shield body system according to claim 1, the shield body system further comprising a rotation unit configured to rotate the shield body together with the substrate on an axis relative to the distribution body and/or relative to a deposition chamber for chemical and/or electrolytic surface treatment.

4. The shield body system according to claim 1, wherein the shield body comprises at least one return aperture configured to direct a return flow of the process fluid in an opposite direction to a direction towards the substrate.

5. The shield body system according to claim 4, wherein the at least one return aperture has an aperture diameter, which is smaller than a diameter equal to the sum of diameters of the plurality of openings of the shield body.

6. The shield body system according to claim 1, further comprising an attachment unit configured to attach the shield body to the substrate or to the substrate holder holding the substrate.

7. The shield body system according to claim 1, the shield body system further comprising an alignment unit configured to align the shield body relative the substrate.

* * * * *